US007144050B2

(12) United States Patent
Lin

(10) Patent No.: US 7,144,050 B2
(45) Date of Patent: Dec. 5, 2006

(54) FIRE-BLOCKING DOOR LOCK STRUCTURE

(76) Inventor: Ching-Tien Lin, No. 2, Lane 112, Chu-Yuan Road Hsin-Chung, Taipei Hsien (TW)

( * ) Notice: Subject to any disclaimer, the term of this patent is extended or adjusted under 35 U.S.C. 154(b) by 502 days.

(21) Appl. No.: 10/692,780

(22) Filed: Oct. 27, 2003

(65) Prior Publication Data

US 2004/0227351 A1 Nov. 18, 2004

(30) Foreign Application Priority Data

May 14, 2003 (TW) ..... 92208758 U

(51) Int. Cl.
*E05B 65/10* (2006.01)

(52) U.S. Cl. ..... 292/93; 292/DIG. 65

(58) Field of Classification Search ..... 292/92, 292/93, DIG. 65
See application file for complete search history.

(56) References Cited

U.S. PATENT DOCUMENTS 5,464,259 A * 11/1995 Cohrs et al. ..... 292/92
6,641,183 B1 * 11/2003 Brown ..... 292/92
6,820,905 B1 * 11/2004 Haeck et al. ..... 292/93

* cited by examiner

*Primary Examiner*—Gary Estremsky
(74) *Attorney, Agent, or Firm*—Shoemaker and Mattare

(57) ABSTRACT

A fire-blocking door lock structure includes a bolt member mounted inside thereof connected to an actuation mechanism and a latch member connected to the other side of actuation mechanism inside the door lock structure away from the direction of the bolt member by a pull rod. The bolt member includes a pivot joint member, an operating piece, and a retaining piece; the latch member includes a latching frame, a latching support movably installed inside the latching frame, a latching body rotatably positioned inside the latching support, a stop piece movably installed inside the latching frame, and a driving piece having one end thereof pivotally connected with the stop piece and having the other end connected with the pull rod for adapting the force from the pull rod to shift the stop piece and the latching body.

19 Claims, 14 Drawing Sheets

FIRE-BLOCKING DOOR LOCK STRUCTURE

BACKGROUND OF THE INVENTION

1. Field of the Invention

The present invention relates to fire-blocking door lock structures, and more particularly, to a fire-blocking door lock that is suitable for a fire-blocking door with exposed hinges on the top and bottom thereof.

2. Description of the Related Art

A general fire-blocking door lock structure is shown in FIG. 11. Such fire-blocking door lock structure is horizontally positioned on a push plate 111 inside a frame member 110 mounted on the center of a fire-blocking door 100 plank. A latch (not shown) can be retracted inside a casing 112 when the push plate 111 is depressed by a user; in addition, the latch and latch members 200 can be linked by linking pieces 113, thereby both of the latch and the latch members 200 can be simultaneously actuated. The fire-blocking door 100, therefore, can be opened by the actuation of unlatching the door locks. The latch members 200 of a conventional fire-blocking door lock are as shown in FIGS. 12 and 13.

The latch members 200 of a conventional fire-blocking door lock each comprises a first driving piece 70, a second driving piece 71, an output driving piece 72, a connecting rod 73, a driving wheel 74, a torsional spring 76, an arm 77, an insertion of latch bolt 79, a latching body 80, and slide supports 81. The first driving piece 70 has one end thereof contacted with one end of the second driving piece 71; the other end of the second driving piece 71 is further connected with the output driving piece 72. The connecting rod 73 and the driving wheel 74 are linked together; in addition, the driving wheel 74 is rotatably connected to the slide support 81. The second driving piece 71 and the output driving piece 72 are both connected to the driving wheel 74. In addition, a rivet 75 is penetrates a torsional spring 76 positioned on the arm 77, which is subsequently connected with a shaft 78 and the output driving piece 72. The second driving piece 71 and the latching body 80 with the latch bolt 79 inserted to the top thereof are fixed together. A shaft 82 penetrates the slide supports 81 for fastening the connecting rod 73 thereon. The assembly of each latch members 200 is completed as described above.

Subsequently, the latch members 200 are each mounted on the fire-blocking door 100 by a fixed seat 83, corresponding to the linking pieces 113 each for linking to the latch. During the motion of the latch, the driving wheel 74 are respectively coupled to the first driving pieces 70, thereby the second driving pieces 71 and the output driving pieces 72 are driven by the rotation of the driving wheel 74; the latching body 80 and the insertion of latch bolt 79 are jointly driven to move to the extended position outside of the slide supports and the retracted position inside of the slide supports. Consequently, the motion of the fire-blocking door lock enables the latch members 200, which are linked to the latch by the linking pieces 113, to be actuated for achieving the objective of latching or unlatching the door lock structure.

A bolt member 84 comprises a clamp 85 with a hook portion and an operating piece 86, which is coaxial to and clenched by the clamp 85. The hook portion of the clamp 85 can be pivotally turned corresponding to an axis between a first and a second positions; among which the first position is at the position of the bar link (not shown) for clenching and opening the door latch, and the second position is at the position of the bar link for unclenching and opening the door latch. A spring 87 is placed at either the first position or the second position, biased with the clamp 85; in addition, an axial extension piece 88 is used for axially holding the operating piece 86 and the clamp 85.

However, the assembly of such a conventional latch member requires various components; therefore, such a conventional latch member has a complicated structure requiring precision components to precisely connect or couple together. The assembly of such a latch member is a time-consuming work and complicated process; moreover, the manufacturing costs of the various components are high.

In addition, the first driving piece 70, the second driving piece 71, and the output driving piece 72 are coupled to or connected with the driving wheel 74 and jointly actuated by the rotation of the driving wheel 74 corresponding to the linking pieces 113 and the motion of the latch linking with the linking piece 113. The actuation of the latch enabling the latching body 80 and the insertion of latch bolt 79 to be jointly driven to move to the extended position outside of the slide supports and the position inside the slide supports makes the whole process complicated. Therefore, in order to ensure the door lock to be latched or unlatched a user has to exert greater physical strength to actuate the various door lock components, which must be driven in good coordination.

Meanwhile, the complicated structure of such a conventional latch member results in difficulty in dismantling and replacing old components with new components; in addition, other components may be damaged during component replacement. Consequently, the lifetime of such conventional latch member is easily shortened.

The hook portion of the bolt member, which is positioned in either the first position or the second position, easily departs from the original position due to a strike or intentional damage. Consequently, the operating piece of the latch can malfunction; in addition, the spring, which is placed at either the first position or the second position, can not be used for precisely biasing with the clamp without appropriate support and ensuring the precise actuation of the operating piece and the clamp. When such a conventional latch member is damaged, the fire-blocking door lock is unable to be unlatched as the driving wheel 74 is loosened, or the fire-blocking door lock is unable to be latched as the latching body is retracted inside the fixed seat. In such cases, the functionality of a fire-blocking door lock can not be assured.

Seeing that the latch member and the bolt member of such a conventional fire-blocking door lock structure have various problems that are unfavorable to assemble and manufacture die to the complicated structure described above, the door lock structure requires a greater physical strength to actuate the door latch. In addition, the lifetime of the door latch is easily shortened and the efficacy of the fire-blocking door usage is reduced. It is obvious that such a conventional fire-blocking door lock structure requires improvement.

SUMMARY OF THE INVENTION

In view of said prior technique of a conventional fire-blocking door lock, the primary objective of the present invention aims at providing a simplified fire-blocking door structure.

Another objective of the present invention aims at providing a fire-blocking door lock structure with modularized components and parts.

Another objective of the present invention aims at providing a fire-blocking door lock structure, which enables maintenance costs to be effectively reduced.

Another objective of the present invention aims at providing a fire-blocking door lock structure with a longer life.

To achieve said and other objectives, the present invention provides a fire-blocking door lock structure comprising latch members and a bolt member. The bolt member is connected to one end of an actuation mechanism inside the door lock structure; the latch members are positioned on both sides of the actuation mechanism inside the door lock structure at the end away from the direction of the bolt member and connected to the actuation mechanism through the respective pull rods.

The bolt member is connected to the other end of the draft bar for latching and unlatching the door lock. The bolt member comprises a pivot joint member, an operating piece penetrating the pivot joint member, a retaining piece positioned between the pivot joint member and the operating piece, and a driving piece pivotally connected to the pivot joint member and sleeved by a spring. The pivot joint member comprises a first pivot joint and a second pivot joint rotatably connected with the driving piece. The operating piece and the pivot joint member are coaxial and engaged between the first pivot joint and the second pivot joint. In addition, the retaining piece is used for axially supporting and extending the operating piece and the first pivot joint, thereby enabling the door lock to be latched and unlatched.

The latch members are symmetrically positioned, each comprising a latching frame, a latching support movably positioned inside the latching frame, a latching body rotatably positioned inside the latching support, a stop piece, which is movably positioned inside the latching frame and the latching support and urged against the latching body for shifting the latching body outside or inside latching support, and a driving piece, which has one end pivotally connected with the stop piece and the other end connected to a pull rod, thereby a force from the pull rod is used for shifting the stop piece and the latching body.

The latching frames are frames with recess portions for positioning the latching supports, the latching bodies, the stop pieces, and the driving pieces inside thereof; in addition, the latching frames have guide slots and holes formed therein respectively. The latching supports respectively have guide slots formed. The guide slots on the latching supports individually correspond to the guide slots on the respective latching frames, allowing both of the latching supports to be separately and movably positioned inside the latching frames; thereby the latching bodies, the stop pieces, and the driving pieces are separately positioned inside the latching supports.

The movable latching bodies are each respectively positioned inside the latching supports, and can be retracted to the inside of the latching supports for unlatching the fire-blocking door locks and extended outside of the latching supports for latching the door locks. The latching bodies are each formed with a stop portion and two holes. First shafts respectively penetrate the holes on the latching frames and on the latching bodies, thereby enabling the latching bodies to be secured to the latching frames, allowing the latching frames and the latching bodies to be jointly actuated. The stop portions are respectively positioned head-on the stop pieces.

The stop pieces further separately form positioning portions and guide slots, which are formed corresponding to the guide slots on the latching frames and the guide slots on the latching supports, thereby the stop pieces are separately positioned inside both of the latching frames and the latching supports. The stop pieces are urged against the latching bodies when there is no external force applied thereto; the angles of the stop pieces can be changed when an external force is applied. In other words, the stop pieces can be used for retaining part of the stop portions of the latching bodies on the outside of the latching supports, when no external force is applied; conversely, the latching bodies can be retracted inside the latching supports when an external force is applied to release the force protruding the latching bodies outside of the latching support. The latching bodies, therefore, can be retracted inside or extended outside of the latching supports under an external force.

The driving pieces further are separately formed with guide slots and holes. The guide slots of the driving pieces are formed to correspond to the guide slots of the latching frames and the latching supports and the stop pieces. The driving pieces, therefore, enable one end thereof to be pivotally connected with the latching frames, the latching supports, and the stop pieces, separately. In addition, the driving pieces each can optionally be connected to the positioning portion of each stop piece by dint of at least a first spring member, which enables the stop piece to be retained at a fixed position urging against the latch when any external force is applied. Meanwhile, the driving pieces have the other sides thereof connected with the pull rods, thereby the stop pieces can be shifted by an applied force from the pull rods.

The latching frames, the latching supports and the driving pieces have one of their ends separately and pivotally connected with the stop pieces by second shafts, and have the other ends pivotally connected to and respectively penetrate the pull rods by dint of third shafts; thereby the latching supports, the stop pieces, and the driving pieces can be simultaneously actuated.

At least a second spring member can be selectively positioned between each of the latching frames and the driving pieces. The second spiral spring is not compressed when the driving pieces are not pulled by the pull rods; the second spring member is compressed when an external force is applied and the driving pieces are pulled by the pull rods. Once the pulling force from the pull rods is released, the latching supports, the latching bodies, the stop pieces, and the driving pieces return to their original positions due to a recoiled force from the spring member. The pull rods further comprise connecting units, which can selectively be penetrated by the third shafts penetrating the latching supports, the stop pieces and the driving pieces, thereby enabling the latching frames, the latching supports, and the driving pieces to be separately and pivotally connected with the pull rods.

The actuation mechanism inside the door lock structure connected to the latch members and the bolt member comprises at least a revolving block, a draft bar, a slide support, and a latch block. The actuation mechanism inside the door lock structure is connected to the latch members by dint of the latch block, which, in addition, enables the bolt member to be connected to the draft bar by dint of a draft stand. The first pivot joint of the bolt member is pivoted on the draft bar and shifted between a first position and a second position of the draft bar. The first position of the draft bar is a position of to engage with and drive the latch member; where the second position of the draft bar can not engage with and drive the latch member. The second pivot joint can be biased with the first pivot joint at either the first position or the second position by dint of the spring member in the driving piece, thereby latching and unlatching the door locks can be assured.

When the push plate is perpendicularly pressed down by a user, the revolving blocks have one of their ends thereof driven and rotated along pivot holes of a lower support, and have the other ends swung and nudged with the connected draft bar moving horizontally to shift the latch block. The latch block is movably and pivotally installed inside a slide support, which has the front end thereof formed with a pivot hole for a pin to penetrate the latch block, thereby the slide support and the latch block are pivotally connected with each other. The slide support has the rear end thereof connected with the draft bar by penetrating a pin through linking pieces. When the push plate is pressed down, the latch block is swung by a force from the draft bar and respectively drives the components inside the latch members for simultaneously actuating the latch members, thereby, the door locks are latched or unlatched.

When the push plate is pressed down by a user for unlatching the door lock through the actuation mechanism inside the door lock structure, the pull rods respectively use the connecting units thereof for actuating the latching supports and the driving pieces inside the latch members, enabling the driving pieces to change the positions of the stop pieces in order to simultaneously drive the latching bodies to be retracted inside the latching frames. Therefore, by dint of actuating the actuation mechanism inside the door lock structure, the pull rods are driven to enable the latch members to be simultaneously actuated to carry out the motion of unlatching the door lock.

When the push plate is released to remove the force required for actuating the actuation mechanism, the actuation mechanism returns to its original latched position; consequently, the force of driving the pull rods is removed, thereby the latching supports and the driving pieces driven by the pull rods can be restored to their original positions by recoiled force of the second spring member which is generated during the motion of unlatching the door lock. Subsequently, the driving pieces enable the stop pieces to be restored to their original positions by the second spring member positioned between the driving pieces and the latching frames. Thus, the stop pieces are urged against the latching bodies, which are firmly restored to and retained on the positions outside the latching members; thereafter the latch members simultaneously carry out the motion of latching the door lock.

Therefore, the fire-blocking door lock structure of the present invention uses a more simplified technique than conventional ones; thus, its components are more favorable to assemble and manufacture. The invention enables a user to easily open the fire-blocking door with less effort and, in addition, modularizes various components, enabling the modularized components to be easily maintained, and allowing the lifetime of these components to be prolonged. Thus, the invention disclosed herein assures the efficacy of securely using the fire-blocking door lock.

The characteristics and efficacy of the invention are detailed by the brief description of the preferred embodiments and the drawings as follows. It is understood that the drawings described herein are merely illustrative of the principles of the invention, and not intended to limit or restrict the invention.

DETAILED DESCRIPTION OF THE PREFERRED EMBODIMENTS

Figure 1:
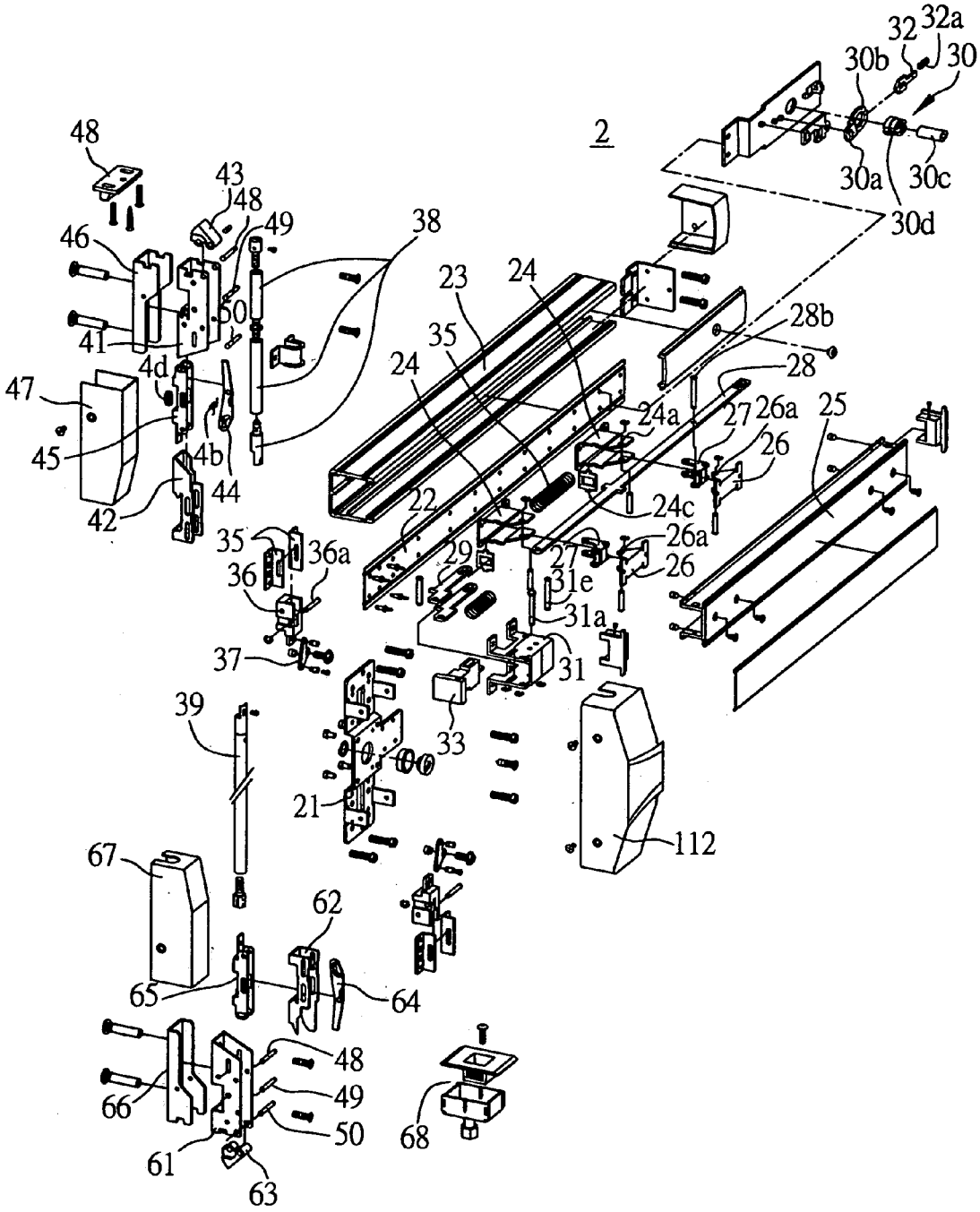
FIG. 1 is an exploded perspective view of an entire fire-blocking door lock according to the present invention.

FIGS. 1 to 11 show preferred embodiments of the fire-blocking door lock structure of the present invention. According to the fire-blocking door lock structure of the present invention, latch members and a bolt member are connected to a door latch device 2 of the fire-blocking door lock. The illustrative embodiments of the present invention are described using the door latch device for actuating the fire-blocking door lock. The present invention can be applicable to conventional fire-blocking doors without changing the structure of such fire-blocking doors. Therefore, to simplify the descriptions, the descriptions of the embodiments herein for the fire-blocking door lock structure of the present invention are based on a fire-blocking door 100 of the prior technique mentioned above as an example.

As shown, the door latch device 2 is mounted on the fire-blocking door 100, comprising a casing 112, a base body 21, a frame member 23, and a push plate 111 forming a constituent body mounted on the fire-blocking door plank. The door latch device 2 further has two rotating blocks 27, a draft bar 28, a slide support 31, and a latch block 33 forming an actuation mechanism inside the door lock structure. The actuation mechanism inside the door lock structure is connected to latch members 4 and 6 on both sides of the base body 21 by pull rods 38 and 39, respectively.

Figure 2:
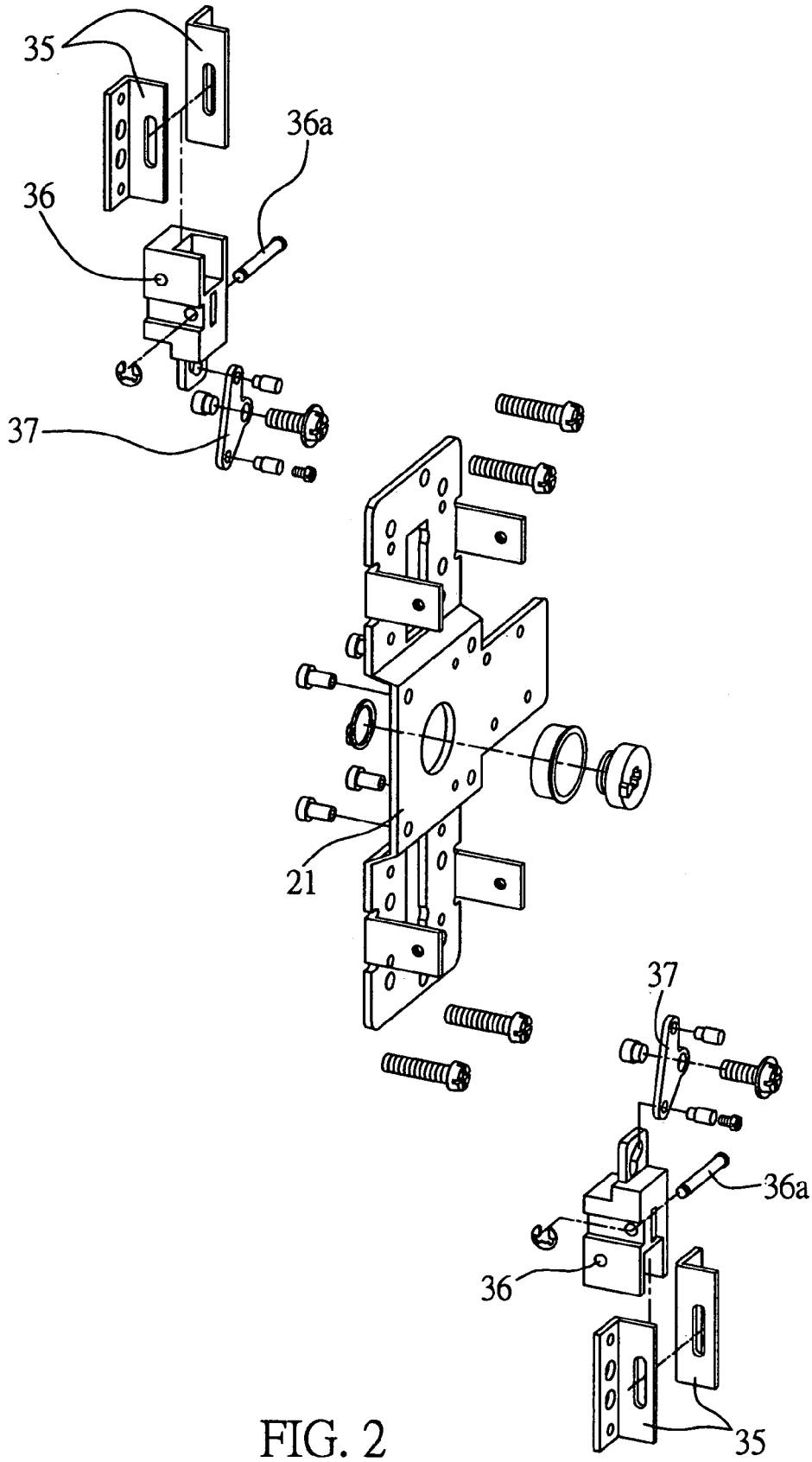
FIG. 2 is a perspective view showing the lock-up of the casing according to the present invention.
Figure 3:
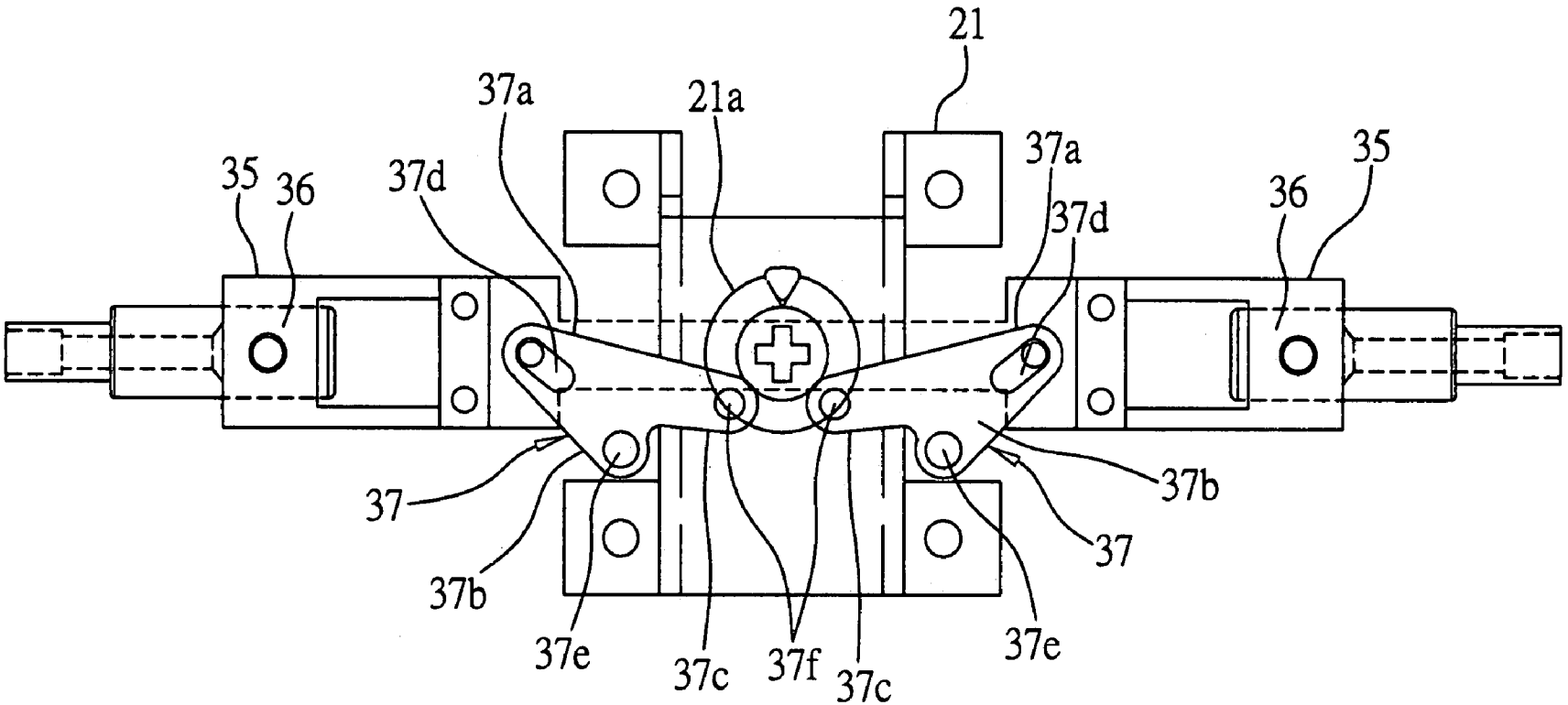
FIG. 3 is a perspective view showing part of the actuation mechanism inside the door lock structure of the present invention when the door is latched.

As shown in FIG. 2, the actuation mechanism inside the door lock structure is mounted inside the casing 112 of FIG. 1 and comprises a pair of sliding blocks 36, which are respectively positioned in opposite directions inside the sliding block supports 35 on both lateral sides of the base body 21, and a pair of first driving pieces 37, which are respectively connected with the sliding blocks 36 and penetrated by said pins 36*a*. As shown in FIG. 3, each of the first driving pieces 37 is formed to pivotally turn and shift on the base body 21 in right-angled curving shape to connect to each of the sliding blocks 36. Each of the first driving pieces 37 further comprises a first nose 37*a*, a second nose 37*b* and a third nose 37*c*, with pivot boles 37*d*. 37*e* and 37*f* respectively formed on said noses. The first nose 37*a* of the first driving piece 37 is rotatably and pivotally connected with the sliding block 36 through the hole 37*d*; the second nose 37*b* is pivotally connected to the base body 21 through the hole 37*e*; the third nose 37*c* is pivotally connected to the latch block 33 through the hole 37*f*.

The casing 112 has the bottom thereof mounted on the base body 21 and connected to a frame plate 22. The frame member 23 is a frame with a recess portion for a frame plate 22 to be mounted; two lower supports 24 are rigidly secured to both sides of the frame plate 22, respectively, with pivot holes 24*a* set on the top each. The push plate 111 can be pressed down by a user for unlatching the door lock and is installed inside the frame member 23 for being moved upwards and downwards; two upper supports 26 are rigidly secured on both sides on the bottom of the push plate 11, respectively, with holes 26*a* set on the bottom of each.

Figure 4:
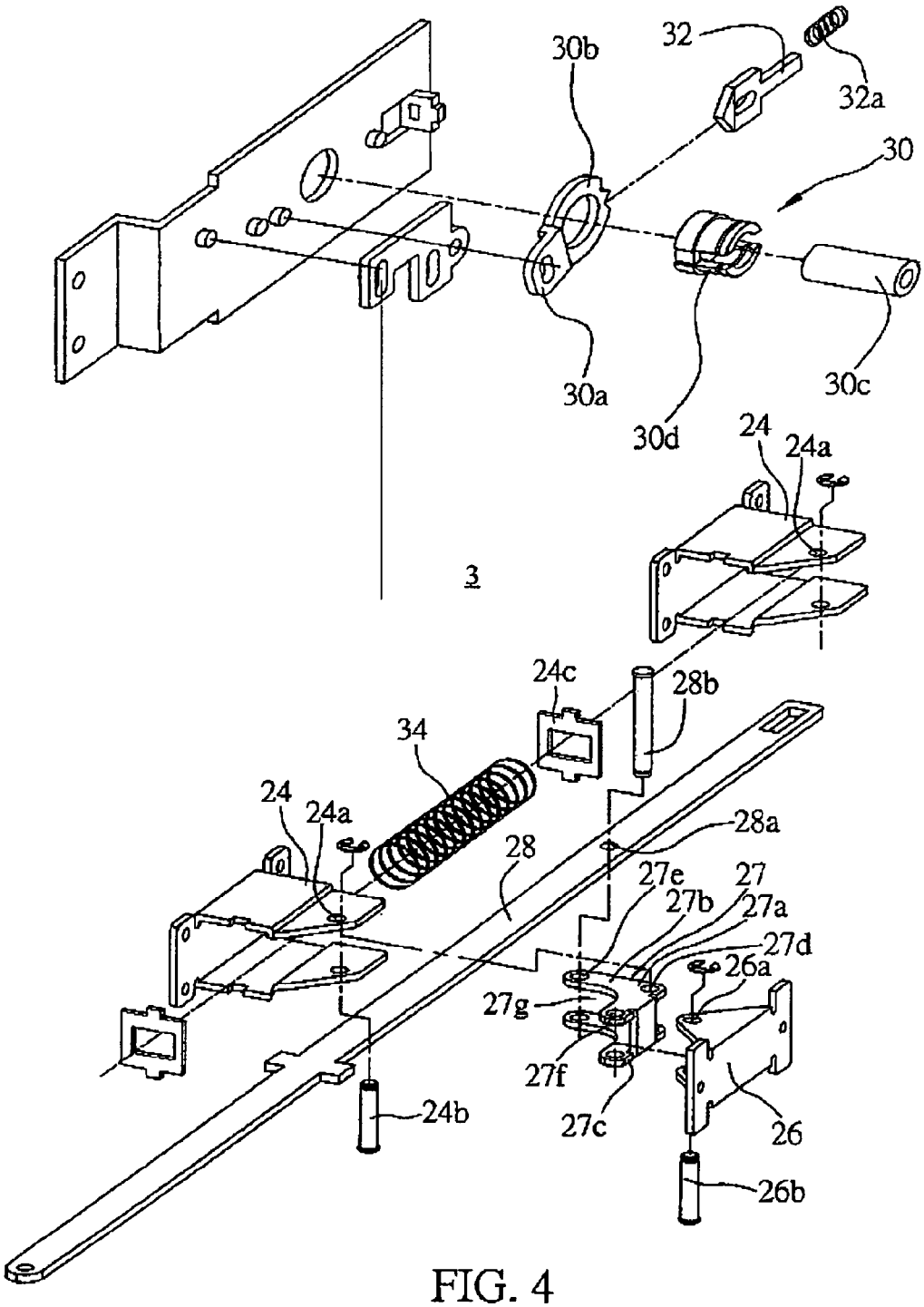
FIG. 4 is a perspective view showing another part of the actuation mechanism inside the door lock structure of the present invention.

As shown in FIG. 4 each of the pivoting blocks 27 is formed in a right-angled curving shape and pivotally installed and shifted on the push plate 111 and connected to the lower supports 24. Each of the driving pieces 27 further comprises a first nose 27*a*, a second nose 27*b*, and a third nose 27*c*, with pivot holes 27*d*, 27*e* and 27*f* respectively positioned on each said noses. The draft bar 28 is formed as a strip shape and fixedly secured to one end of the revolving blocks 27. The draft bar 28 has both sides thereof pivotally secured on the second noses 27*b* of the pivoting blocks 27 using respective pins for penetrating the holes 27*e*. Moreover, the draft bar 28 has one end thereof pivotally connected to the linking pieces 29 for generating a parallel pull force owing to the actuation of the draft bar 28. There are two pivoting blocks 27 employed in the embodiment; however, it is understood that one or more than two pivoting blocks 27 are applicable to the present invention; in addition, the shapes of the pivoting blocks 27 can vary without being limited by the embodiment herein.

The push plate 111 has both inner ends thereof secured to the upper supports 26, which have the bottom sides thereof formed with holes 26*a*, which together with the holes 27*f* at the third nose 27*c* are inserted with the pin 26*b*, thereby the pivoting blocks 27 are pivoted on the pin 26*b* and swung inside the upper support 26. In addition, the pivoting blocks 27 have hollow portions 27*g* each enabling the draft bar 28 to shift through. Moreover, each of the holes 27*d* at each first nose 27*a* of the pivoting blocks 27 is connected to each of the holes 24*a* on the top of each of the lower supports 24 by insertion of a pin 24*b*; in addition, each of the holes 27*e* at each second nose 27*b* of the pivoting blocks 27 is connected to each of the hole 28*a* on the draft bar 28 by insertion of a pin 28*b*.

The bolt member 3 can be used to latch and unlatch the door lock. One end of the draft bar 28 is connected with a pivot joint member 30 while the other end is away from the actuation mechanism inside the door lock structure. The pivot joint member 30 is movably positioned inside a draft stand 28*d* and pivotally connected to the draft bar 28. The pivot joint member 30 comprises a first pivot joint 30*a*, which can be rotatably and pivotally connected to the draft stand 28*d*, and a second pivot joint 30*b*, which can be rotatably and pivotally connected with a driving piece 32 sleeved by a spring 32*a*. An operating piece 30*c* (such as a latch) coaxial to the pivot joint member 30 is engaged with both of the first pivot joint 30*a* and the second pivot joint 30. Moreover, a retaining piece 30*d* is utilized for axially extending both of the operating piece 30*c* and the first pivot joint 30*a* along the axis. The first pivot joint 30*a* is pivoted on the draft bar 28 and shifted between a first position and a second position of the draft bar 28. The first position of the draft bar 28 is a position for engaging and disengaging the operating piece 30*c*; the second position of the draft bar 28 is a position that does not allow engaging and disengaging the operating piece 30*c*. The second pivot joint 30*b* can be biased with the first pivot joint 30*a* at either the first position or the second position by dint of the spring 32*a* in the driving piece 32.

The bolt member 3 in the embodiment is applied to a fire-blocking door lock structure with exposed hinges, however, it is understood that the bolt member 3 can be applicable to other kinds of fire-blocking door locks and is not subject to limitation herein.

The pivot joint member 30 of the invention can be utilized for resolving a conventional door lock problem where the hook portion of the holdfast member 12*p* is easily dislodged from its original position due to a strike or intentional damage. In addition, the invention improves from another drawback of the prior technique wherein the clamp 12*q* can not be appropriately biased and retained by the spring 12*s*. The pivot joint member 30 of the invention not only ensures the efficacy of the operating piece 30*c* of a latch piece, but also ensure the first pivot joint 30*a* to be biased at either the first position or the second position, thereby adjustment of the pivot joint member 30 is possible in several phases, ensuring the precise actuation of the operating piece 30*c* and the first pivot joint 30*a*.

Figure 5:
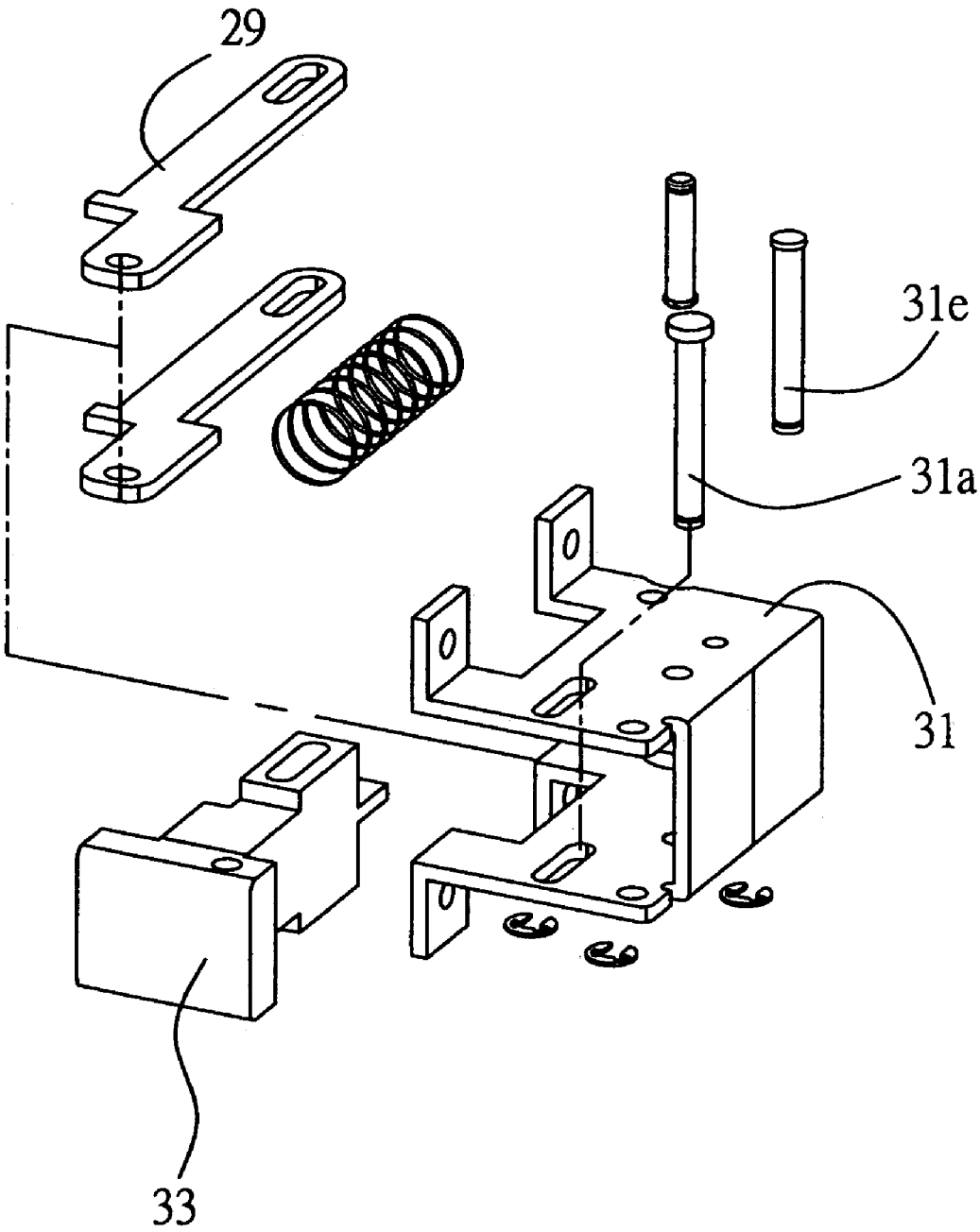
FIG. 5 is a perspective view showing another part of the actuation mechanism inside the door lock structure of the present invention.

As shown in FIG. 5, the slide support 31 is connected to the frame plate 22 by a pin 31*a* through slots formed in the slide support 31; the linking pieces 29 each have one end connected to the latch block 33 for driving the latch block 33 to swing and receiving a parallel pull force generated from the actuation of the draft bar 28, thereby such force is transmitted to the latch block 33 generating a horizontal displacement, which enables the draft bar 28 inside the slide support 31 to be horizontally shifted, thereby the actuation mechanism of the door lock structure accommodated in the casing 112 can be actuated.

Figure 6:
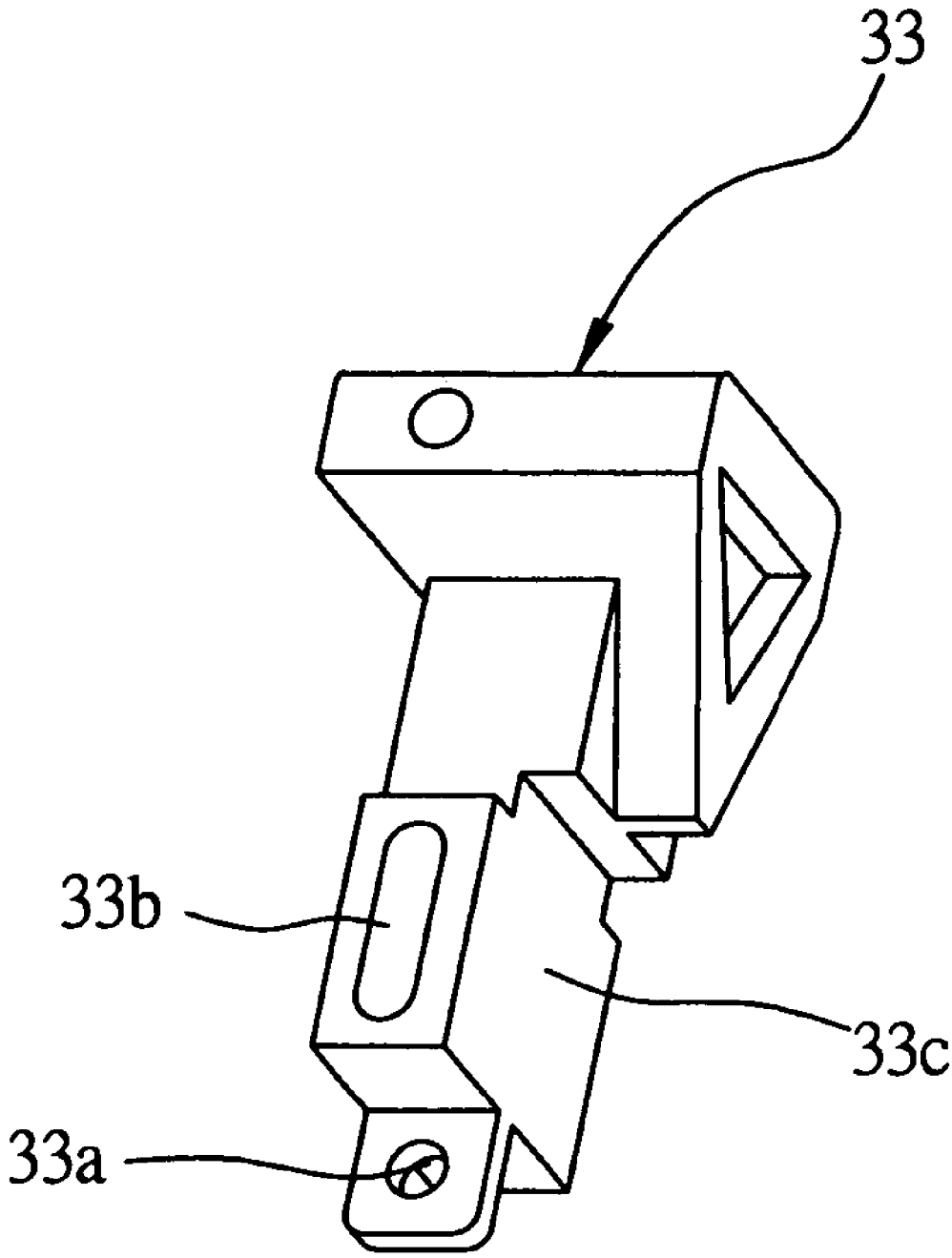
FIG. 6 is a perspective view showing the sliding block inside the actuation mechanism of the door lock structure of the present invention.

As shown in FIG. 6, the latch block 33 comprises two pivot holes 33*a* formed through both sides thereof, a pivot hole 33*b* on the top of one side thereof and a recess portion 33*c* formed near the side of the pivot hole 33*h*. The latch block 33 is connected with each third nose 37*c* of the first driving pieces 37 through the two pivot holes 33*a*, and, in addition, connected with the linking pieces 29 through the pivot hole 33*b*. The recess portion 33*c* enables no contact of the latch block 33 is made with the casing 112 while the latch block 33 is retracted to the inside or extended outside of the latching supports. The embodiment illustrates that the latch block 33 is pivotally connected to each third nose 37*c* of the first driving piece 37 by the holes 33*a* on both sides of the latch block 33 for actuating the first driving pieces 37. It is understood that the first driving piece 37 can also be driven by the latch block 33 in other structural forms. For example, the latch block 33 may have two retaining portions formed both lateral sides, thereby enabling each third nose 37*c* of the first driving pieces 37 to be pivotally shifted and retained inside the latch block 33. Therefore, a latch block can vary without being limited by the embodiment herein.

Figure 7A:
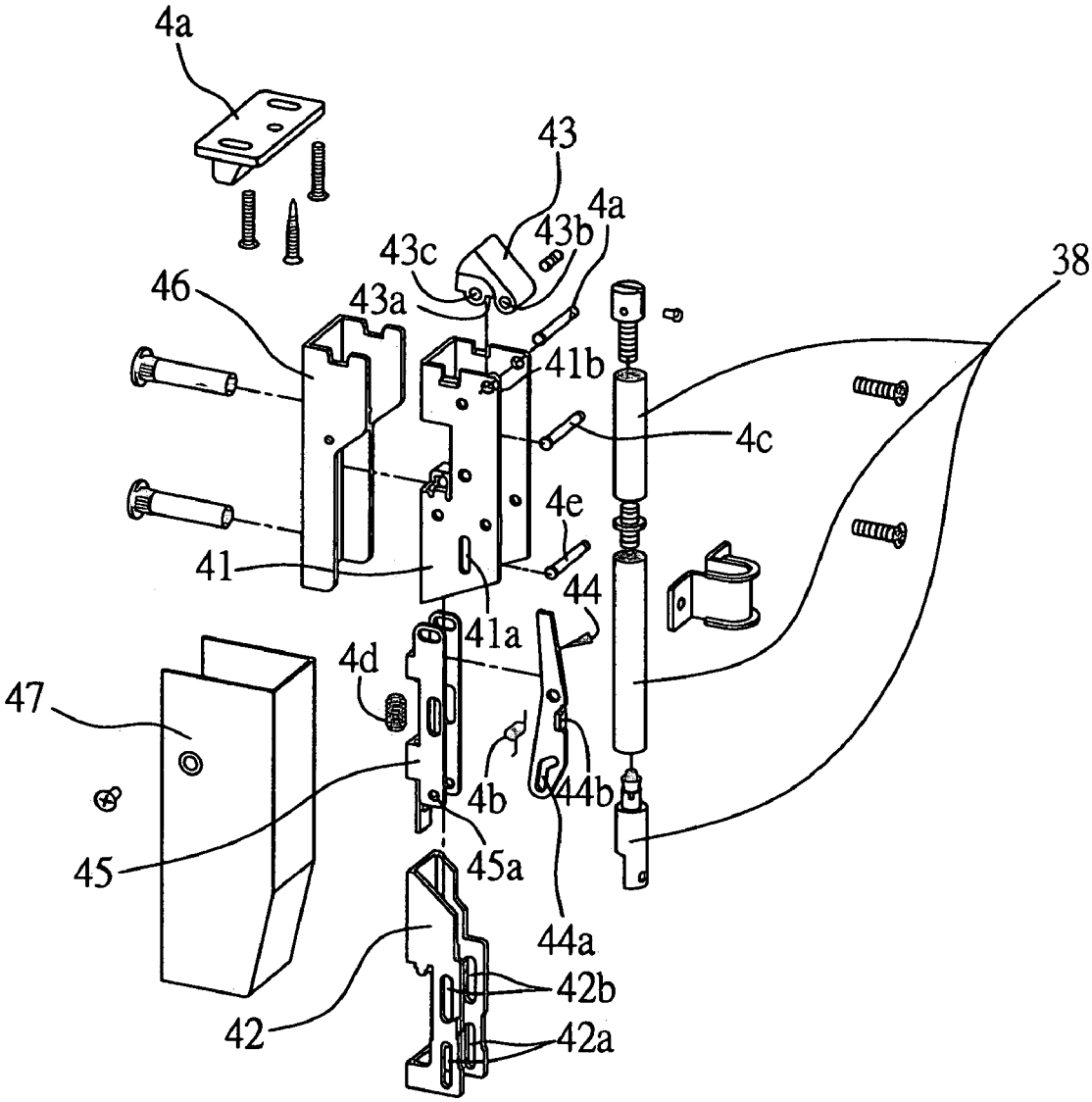
FIGS. 7A and 7B are perspective views of the latch members according to the present invention.
Figure 7B:
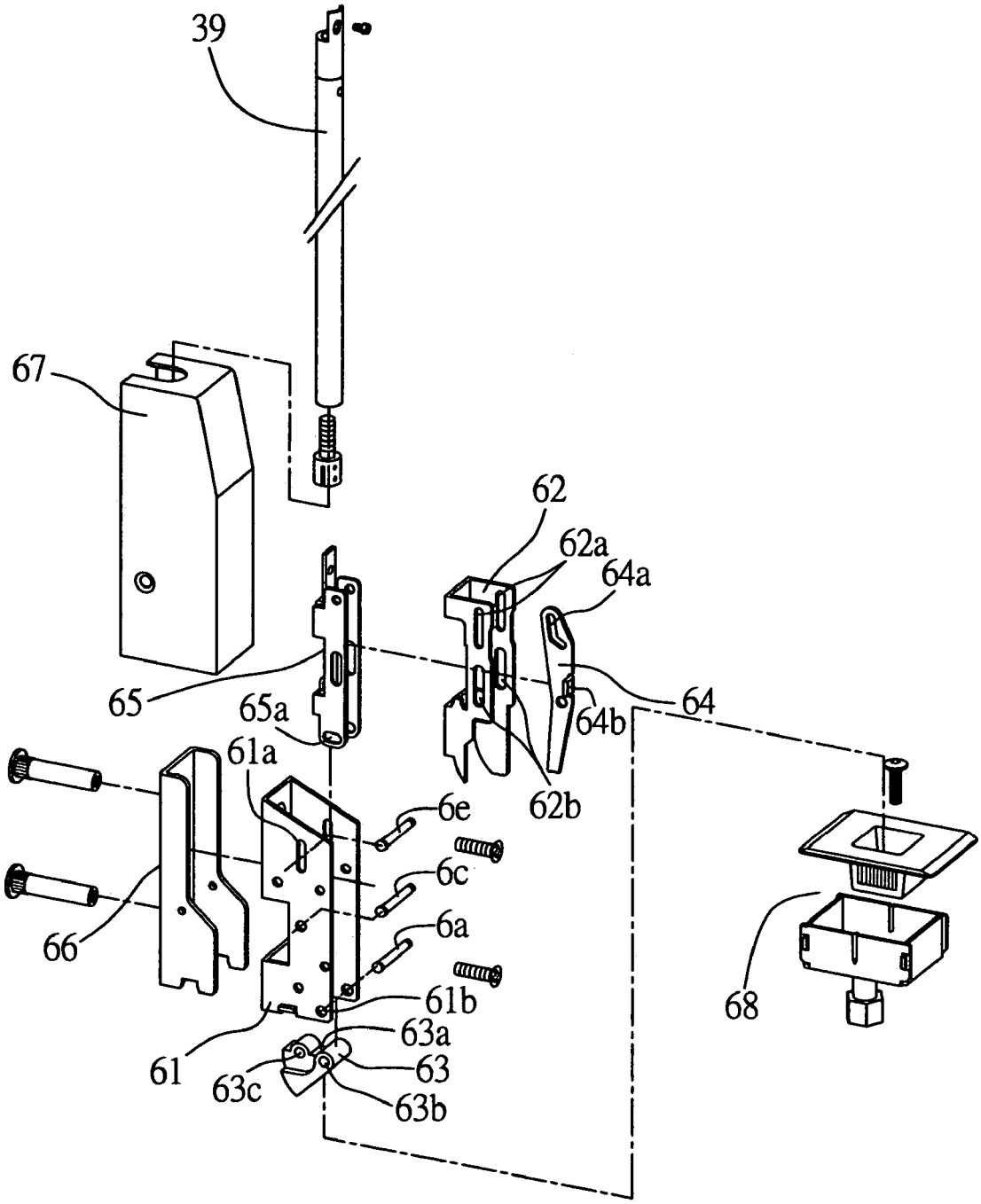

The latch members 4 and 6 are separately positioned on the upper and the lower sides of the fire-blocking door 100, and respectively connected to the actuation mechanism inside the door lock structure on both sides of the base body 21 by the pull rods 38 and 39. As shown in FIGS. 1, 7A and 7B, the latch members 4 and 6 respectively comprise latching frames 41 and 61, latching supports 42 and 62, latching bodies 43 and 63, stop pieces 44 and 64, and second driving pieces 45 and 65.

The latching frames 41 and 61 are frames with recess portions for accommodating the latching supports 42 and 62, the latching bodies 43 and 63, the stop pieces 44 and 64, and the second driving pieces 45 and 65. The latching frame 41 is formed with guide slot 41*a* and holes 41*b* and 41*c*; the latching frame 61 is formed with guide slot 61*a* and holes 61*b* and 61*c*. The latching support 42 has guide slots 42*a* and 42*b* formed therein; the latching support 62 has guide slots 62*a* and 62*b* formed therein. The guide slots 42*a* and 62*a* of the latching supports correspond to the guide slots 41*a* and 61*a* of the respective-latching frames 41 and 61, thereby both of the latching supports 42 and 62 are separately and movably positioned inside the latching frames 41 and 61. The latching bodies 43 and 63, the stop pieces 44 and 64, and the second driving pieces 45 and 65 are separately positioned inside the latching supports 42 and 62.

The latching bodies 43 and 63 are rotatably positioned inside the latching supports 42 and 62, and, in addition, can be retracted to the inside of the latching supports for unlatching the fire-blocking door locks, and extended outside of the latching supports for latching the door locks. The latching bodies 43 and 63 are separately formed with stop portions 43*a* and 63*a* and holes 43*b*, 43*c*, 63*b* and 63*c*. The stop portions 43*a* and 63*a* are respectively positioned head-on on the stop pieces 44 and 64, such that first shafts 4*a* and 6*a* can respectively penetrate the holes 41*b* and 61*b* on the latching frames 41 and 61 and the holes 43*b* and 63*b* on the latching bodies 43 and 63. Moreover, the holes 41*c* and 61*c* on the latching frames 41 and 61 and the holes 43*c* and 63*c* on the latching bodies 43 and 63 are respectively penetrated by other shafts (not shown), while these other shafts also pierce through the stop portions 43*a* and 63*a* of the latching bodies 43 and 63. By dint of those shafts, the latching bodies 43 and 63 are secured to the latching frames 41 and 61; consequently, the latching frames 41 and 61 and the latching bodies 43 and 63 can be jointly actuated. Meanwhile, the stop pieces 44 and 64 can be contacted with either those shafts described above or the stop portions 43*a* and 63*a* of the latching bodies 43 and 63 for retaining both of the latching bodies 43 and 63 outside of the latching supports.

The stop pieces 44 and 64 further separately form guide slots 44*a* and 64*a* and positioning portions 44*b* and 64*b*. The guide slots 44*a* and 64*a* of the stop pieces are formed corresponding to the guide slots 41*a* and 61*a* on the latching frames 41 and 61, and the guide slots 42*a* and 62*a* on the latching supports 42 and 62, thereby the stop pieces 44 and 64 are separately positioned inside both of the latching frames 41 and 61 and the latching supports 42 and 62. The stop pieces 44 and 64 are urged against the latching bodies 43 and 63, respectively when there is no external force applied; the angles of the stop pieces 44 and 64 can be changed under an external force. In other words, the stop pieces 44 and 64 can be utilized for retaining part of the stop portions 43*a* and 63*a* of the latching bodies 43 and 63 outside of the latching supports 42 and 62 when no any external force is applied. Conversely, the latching bodies 43 and 63 can be shifted and retracted to inside of the latching supports 42 and 62, when an external force is applied to release the force of retaining the latching bodies 43 and 63 outside of the latching supports. The latching bodies 43 and 63, therefore, can be retracted inside or extended outside of the latching supports due to an external force.

The second driving pieces 45 and 65 further separately have holes 45*a* and 65*a* formed corresponding to the guide slots 41*a* and 61*a* of the latching frames 41 and 61, the guide slots 42*a* and 62*a* of the latching supports 42 and 62, and the guide slots 44*a* and 64*a* of the stop pieces 44 and 64. The second driving pieces 45 and 65, therefore, separately enable each end thereof to be pivotally connected with the latching frames 41 and 61, the latching supports 42 and 62, and the stop pieces 44 and 64. In addition, the second driving pieces 45 can optionally be connected to the positioning portion 44*b* of the stop piece 44 by dint of at least one first spring member 4*b*, which enables the stop piece 44 to be retained at a fixed position (i.e., securely urged against the position of the latching bodies 43) when no external force is applied. In other words, the stop piece 44 can be utilized for retaining the latching body 43 at a position, thereby part of the latching body 43 can be extended outside of the latching support 42. Conversely, the latching body 43 can be retracted inside of the latching support 42 and the force of retaining the latching body 43 is released when an external force is applied.

Meanwhile, the second driving pieces 45 and 65 have the other sides thereof connected with the pull rods 38 and 39 each, thereby the stop pieces 44 and 64 can be shifted by an applied force from the pull rods 38 and 39.

Figure 8:
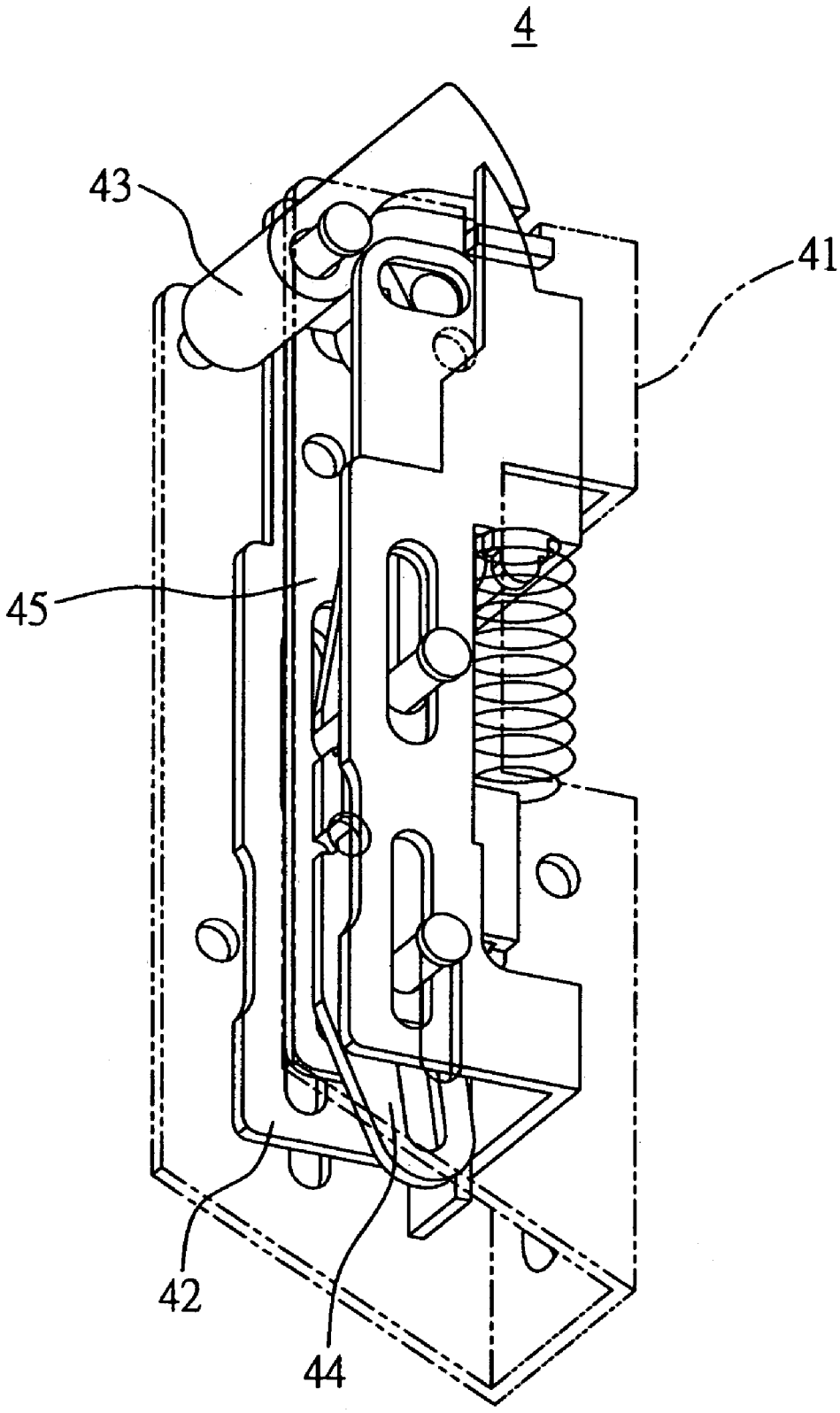
FIG. 8 is a cross-sectional view of the latch member according to the present invention.

The embodiment illustrates that the latching frames 41 and 61, the latching supports 42 and 62, and the second driving pieces 45 and 65 each have one of their ends separately and pivotally connected with the stop pieces 44 and 64 by second shafts 4*c* and 6*c*, and, in addition, have the other ends pivotally connected to and respectively penetrated by the pull rods 38 and 39 by dint of third shafts 4*e* and 6*e*; thereby the latching supports 42 and 62, the stop pieces 44 and 64 and the second driving pieces 45 and 65 are simultaneously actuated. The assembled latch member 4 is shown in FIG. 8.

At least a second spring member 4*d* can be selectively positioned between the latching frame 41 and the second driving piece 45. The second spring member 4*b* is not compressed when the driving pieces 45 and 65 are not pulled by the pull rods 38 and 39. The second spiral spring 4*d* is compressed when an external force is applied and the second driving pieces 45 and 65 are pulled by the pull rods 38 and 39. When the pull force from the pull rods 38 and 39 is released, the latching supports 42 and 62, the latching bodies 43 and 63, the stop pieces 44 and 64, and the second driving pieces 45 and 65 are restored to their original positions due to an elastic force from the spiral spring.

The embodiment merely illustrates that the second driving piece 45 and the stop piece 44 are connected by the first spring member 4*b*, and the latching frame 41 and the stop piece 44 are connected by the second spring member 4*d*. Since the latch members 4 and 6 are actuated together, it is sufficient to have the first spring member 4*b* and the second spring member 4*d* positioned at either latch member 4 or latch member 6 in actual practice. The invention further enables another first spring member 4*b* to connect the driving piece 65 and the positioning portion 64*b* of the stop piece 64, or a plurality of second spring members 4*d* to be positioned depending on the actual needs. It should be understood that the simplified structure in the embodiment is merely an illustration, not intended to limit or restrict the invention.

The pull rods 38 and 39 further respectively comprise connecting units 38*a* and 39*a*, both of which can optionally be inserted with the third shafts 4*e* and 6*e*, such that they are separately and pivotally connected with the latching frames 41 and 61, the latching supports 42 and 62, one end of the second driving pieces 45 and 65 connected to the pull rods 38 and 39. The pull rods 38 and 39 in the embodiment are illustrated as round-shaped rods, however, it should be understood that the actual shapes and the lengths of the pull rods 38 and 39 are not limited by those described in the embodiment herein, and the shapes and the lengths of the connecting units 38*a* and 39*a* also can be changed according to actual needs.

When the push plate 111 is pressed down by the user for unlatching the door lock through the actuation mechanism, pull rods 38 and 39 enable the connecting units 38*a* and 39*a* thereof to drive the latching supports 42 and 62 and the second driving pieces 45 and 65 inside the latch members 4 and 6 respectively, and enable the second driving pieces 45 and 65 to change the positions of the stop pieces 44 and 64 in order to simultaneously drive the latching bodies 43 and 63 to be retracted to inside of the latching frames 41 and 61. Therefore, when the actuation mechanism is actuated by an external force, the pull rods 38 and 39 are driven to enable the latch members 4 and 6 to be simultaneously actuated for unlatching or latching the door locks.

When the push plate 111 is pressed down by a user for unlatching the door lock, the force actuating the actuation mechanism is released and the actuation mechanism is restored to the original latched position. The force to drive the pull rods 38 and 39 is also removed, thereby the latching supports 42 and 62 and the second driving pieces 45 and 65 driven by the pull rods 38 and 39 can be restored to their original positions by the recoiled force of the second spring member 4*d* generated during the motion of unlatching the door lock. Subsequently, the second driving pieces 45 and 65 enable the stop pieces 44 and 64 to be restored to their original positions by the second spring member 4*d* and another second spring member (not shown) positioned between the driving pieces 45 and 65 and the stop pieces 44 and 64. Thus, the stop pieces 44 and 64 are urged against the latching bodies 43 and 63, which are restored to and retained outside the latching supports; thereupon the latch members simultaneously carry out the motion of latching the door lock.

The aforementioned components of the bolt member 3 and the latch members 4 and 6 can be modularized in order to save maintenance costs; thereby parts and components can be easily replaced in the event of breakdowns.

The latch members 4 and 6 composed of the above components can be selectively secured inside fixed seats 47 and 67 using fixed pieces 46 and 66, thereby the latch members 4 and 6 are secured on the fire-blocking door lock. The fixed pieces 46 and 66 are hollow frames and secured to the latching frames 41 and 61 in the embodiment; where the fixed seats 47 and 67 are hollow seats and enable the fixed pieces 46 and 66 of the latch members 4 and 6 to be secured inside thereof. Moreover, the fixed seats 47 and 67 selectively enable fixed seat covers 48 and 68 to be positioned to the fixed seats 47 and 67. Accordingly, the fixed pieces 46 and 66 inside the latch members 4 and 6 respectively can be secured to the fixed seats 47 and 67 under appropriate protection.

In the embodiment, the fixed pieces 46 and 66 are formed as hollow frames, however, it should be noted that such arrangement is merely illustrative of the present invention herein, the fixed pieces 46 and 66 can also be formed as boards; in addition, the fixed seat covers 48 and 68 can vary as long as the latch members 4 and 6 can be securely positioned under appropriate protection.

Since the latch members 4 and 6 of the present invention can be secured to the fixed seats 47 and 67 by the fixed seat covers 48 and 68, the latch members 4 and 6 can be securely positioned under appropriate protection. Moreover, such design improves from the conventional door lock which could not maintain the latching state if the latch member was intentionally destroyed.

Figure 9:
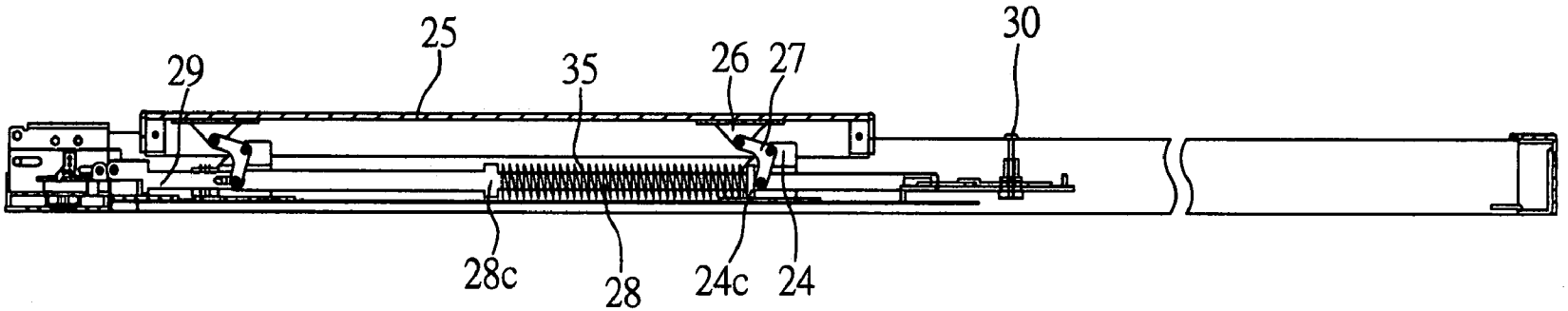
FIG. 9 is a perspective view showing the motion of latching the door latch device of the present invention.
Figure 10:
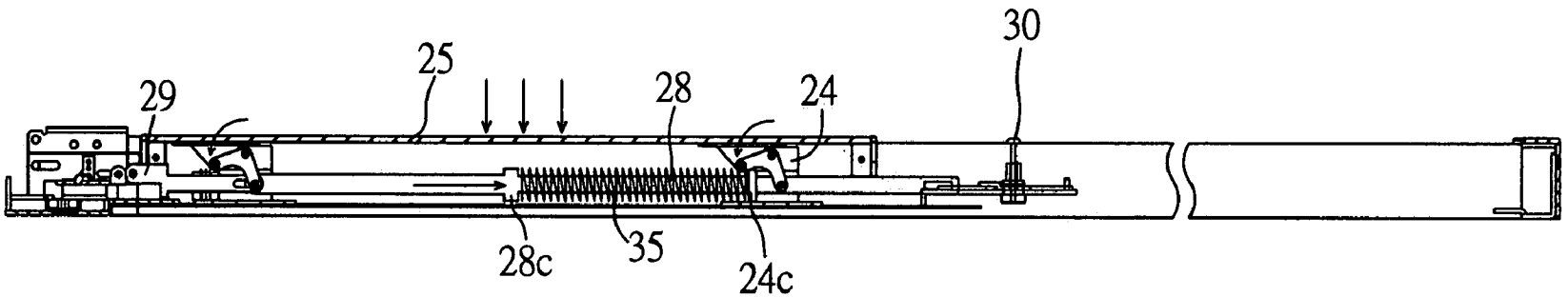
FIG. 10 is a perspective view showing the motion of unlatching the door latch device of the present invention.
Figure 11:
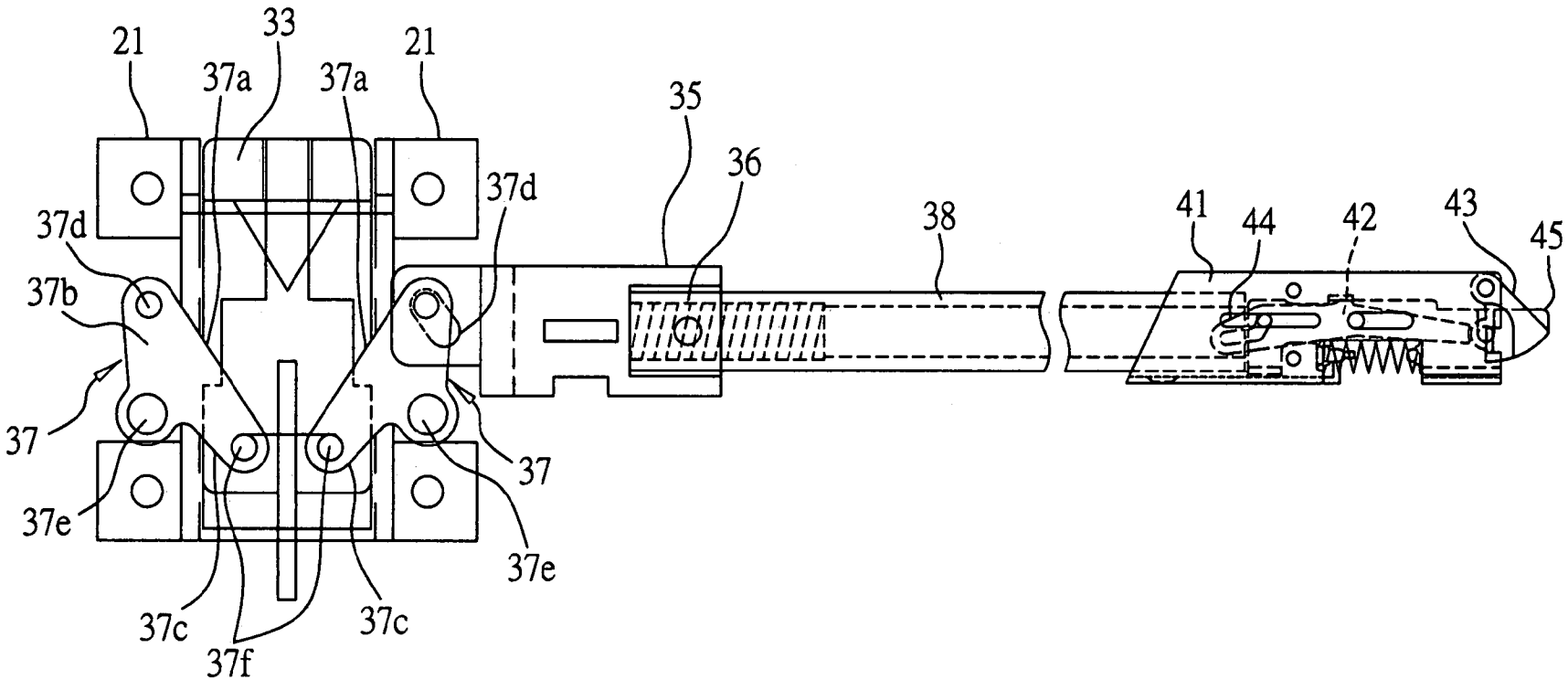
FIG. 11 is a perspective view of components inside the latch member and inside the casing showing the motion of unlatching the door latch device according to the present invention.
Figure 12:
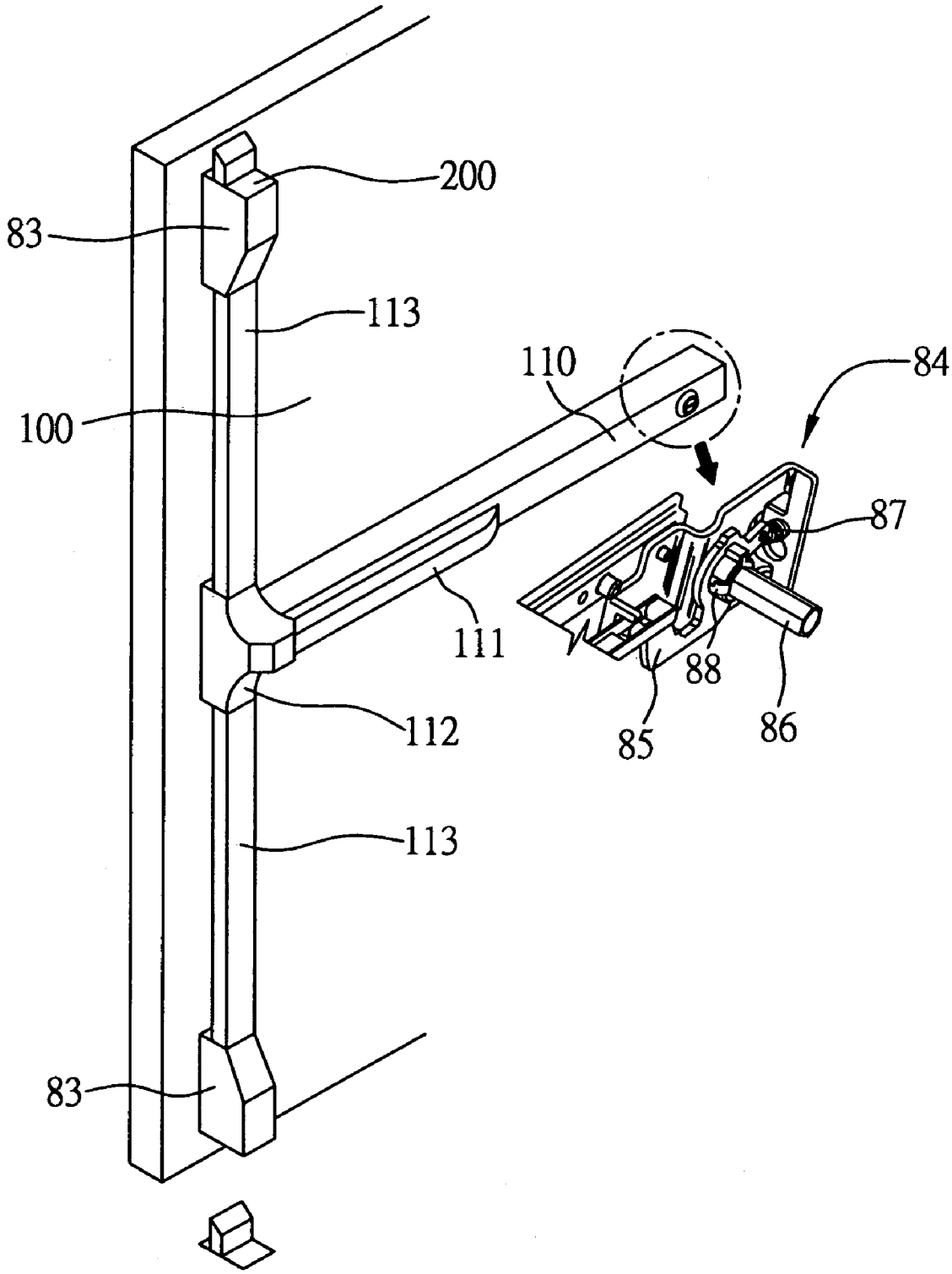
FIG. 12 (PRIOR ART)
FIG. 12 (PRIOR ART) is a perspective view showing a conventional fire-blocking door.
Figure 13:
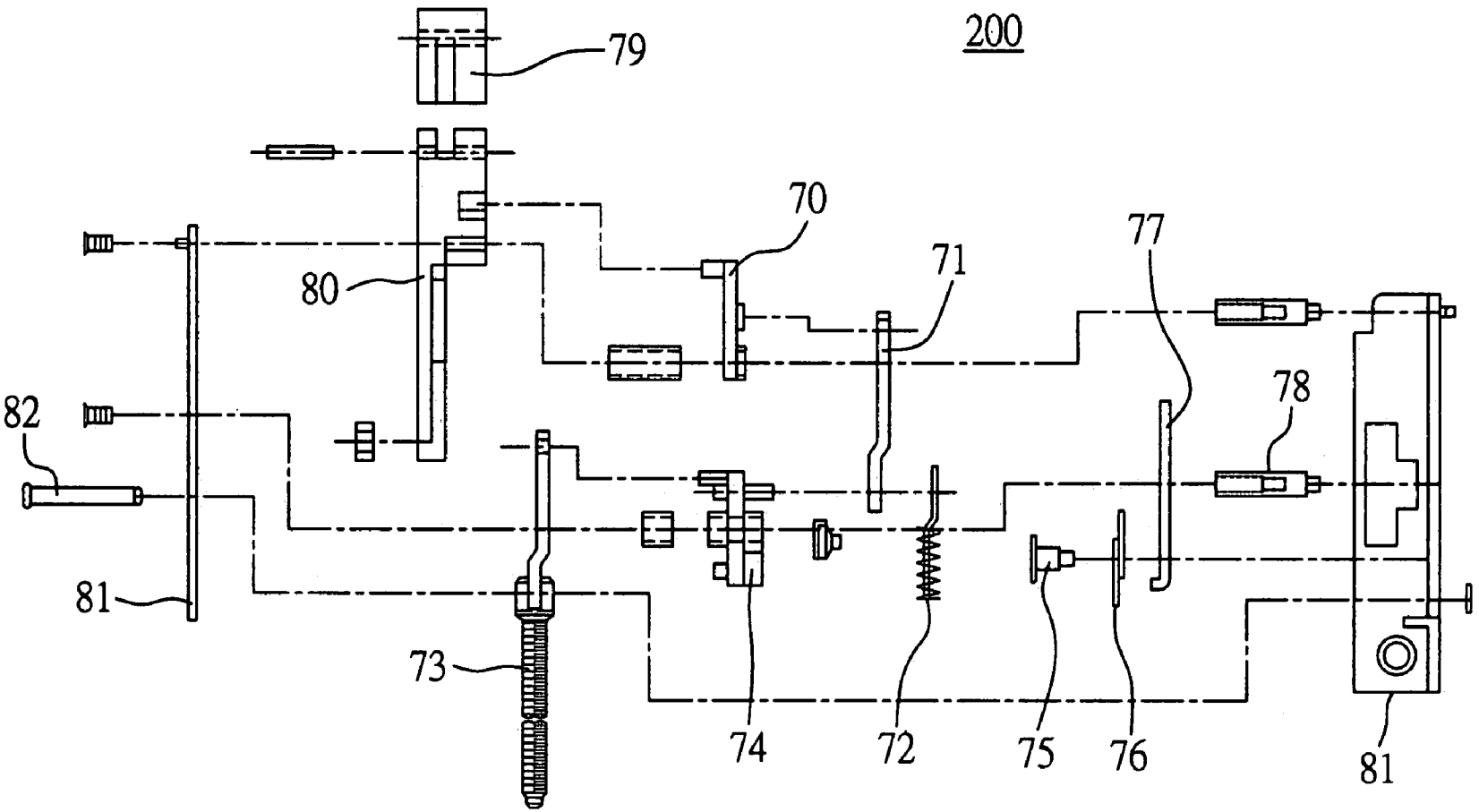
FIG. 13 (PRIOR ART)
FIG. 13 (PRIOR ART) is an exploded perspective view of a conventional fire-blocking door lock structure.
Figure 14:
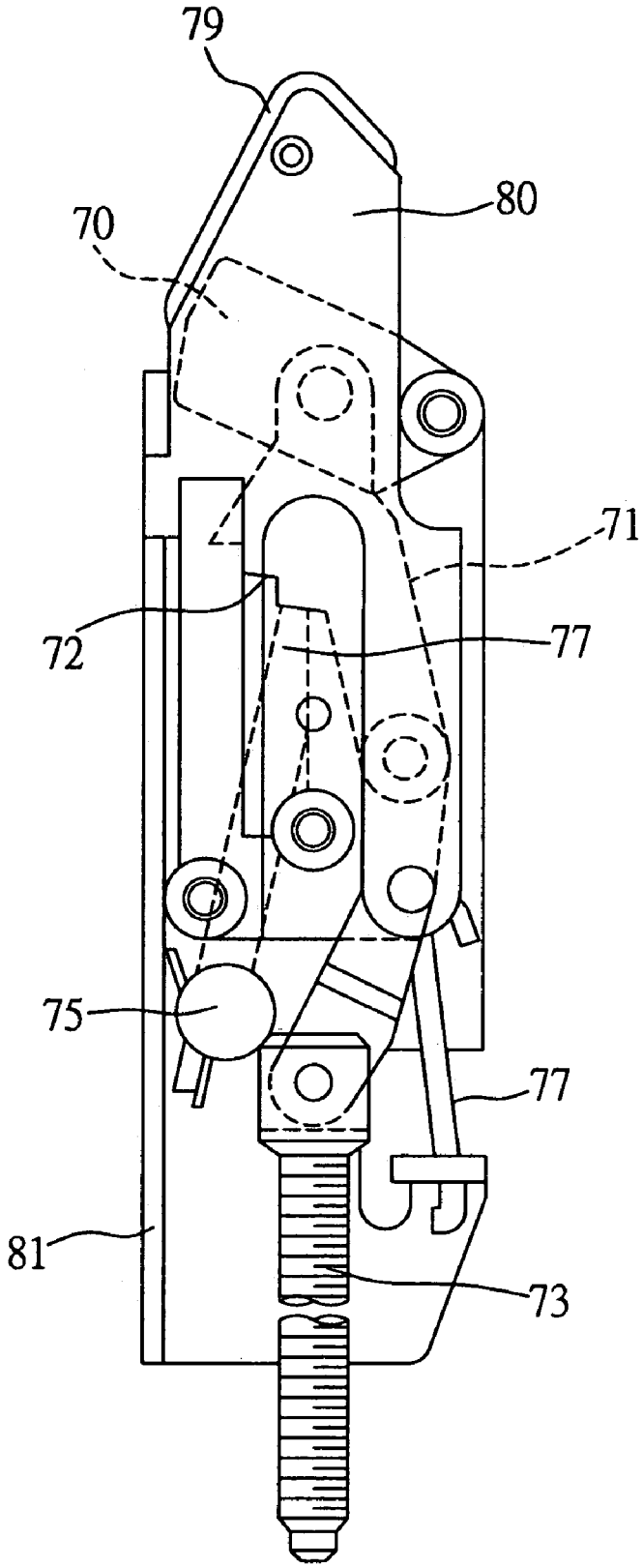
FIG. 14 (PRIOR ART)
FIG. 14 (PRIOR ART) is an assembled perspective view of a conventional fire-blocking door lock structure.

As shown in FIGS. 3 and 9, when there is no an external force applied to the push plate 111, the fire-blocking door lock is latched. As shown in FIGS. 10 and 11, when the upper supports 26 are pushed downwards (following the direction of arrow points) by applying an external force to the push plate 111, each second nose 27*b* of the rotating pieces 27 is simultaneously driven to shift downwards. Each third nose 27*c* of the rotating pieces 27 is swung and pivoted on the pin 24*b* inside the holes 24*a* of the lower supports 24, thereby the draft bar 28 connected to the rotating pieces 27 is shifting horizontally along the direction each third nose 27*c* is swung. Furthermore, the linking pieces 29 and the slide support 31 on the front end of the draft bar 28 shift horizontally backwards, so that the latch block 33 positioned inside the slide support 31 is driven by the linking pieces 29 to swing backwards.

Since the latch block 33 is pivotally connected to each third nose 37*c* on the first driving piece 37, the force driving the latch block 33 to swing backwards and retract inside the slide support 31 also actuates the first driving piece 37. The sliding block 36 connected to the first driving piece 37 and the pull rods 38 and 39 connected to the sliding block 36 jointed actuate the second driving pieces 45 and 65 inside the latch member 4 and the latch member 6 simultaneously. The second driving pieces 45 and 65 are moved due to the force, thereby the first spring member 4*b* connected to the stop piece 44 is forced to actuate the stop piece 44, which is then changed from its original angle (i.e., the angle urging the stop piece 44 against the latching body 43) to another angle without urging the stop piece 44 against the latching body 43 under such force.

Therefore, the force transferred by the pull rods 38 and 39 can simultaneously actuate the second driving pieces 45 and 65 and the stop pieces 44 and 64, such that the stop pieces 44 and 64 are unable to urge against the latching bodies 43 and 63, and the second driving pieces 45 and 65 can drive the latching bodies 43 and 63 to move towards the actuation mechanism inside the door lock structure. Thereby the latching bodies 43 and 63 are retracted back to their original positions for unlatching the door lock.

According to the said components of the fire-blocking door lock of the present invention, the invention enables the user to save effort and easily unlatch the fire-blocking door lock when the push plate 111 is vertically pressed down by the user.

The draft bar 28 has the central portion thereof formed with a protruding stop portion 28*c* sleeved with a locking spring 34 having one end positioned thereon. The locking spring 34 has the other end thereof positioned inside an arresting piece 24*c* of the lower supports 24. Therefore, a recoiled force after compression of the locking spring 34 enables the draft bar 28 to horizontally shift back to its original position (as shown in the arrow direction), thereby the linking pieces 29 at the front end of the draft bar 28 and the slide support 31 are horizontally shifted forwards. Consequently, the latch block 33 positioned inside the slide support 31 is driven by the slide support 31 to swing forward. The latch block 33 then drives the actuation mechanism inside the door lock structure, so that the latching bodies 43 and 63 inside latch member 4 and latch member 6 are actuated by the pull rods 38 and 39 to extend to outside of the latch frames in order to achieve latching the door.

The second driving pieces 45 and 65 inside the latch members 4 and 6 of the fire-blocking door lock structure of the present invention can simultaneously enable the latching bodies 43 and 63 to be shifted between positions of being retracted inside and being extended outside the latch frame supported by a force from the pull rods 38 and 39. The present invention resolves a conventional problem by simplifying the fire-blocking door lock structure, enabling various parts to be securely coupled and connected, thereby the assembly process can be shortened and the manufacturing cost of making various components is reduced. The invention, therefore, is favorable for the assembly and manufacture of a fire-blocking door lock structure.

Meanwhile, since the fire-blocking door lock structure of the present invention is simplified and the actuation process of latching and unlatching the door lock are easier and more powerful, the invention improves from the conventional door lock which requires a greater force to actuate all components of a door lock. In addition, the invention ensures all components to be jointly actuated for achieving the objectives of latching or unlatching the door lock.

Moreover, the fire-blocking door lock structure of the present invention enables all components and parts to be modularized, thereby damaged parts can be easily disengaged from such a simplified door lock structure. The invention, therefore, provides a fire-blocking door lock structure that can be easily maintained and used longer without the drawback of needing to dismantle the components of a conventional door lock in order to replace a defective part.

In view of the foregoing, the fire-blocking door lock structure of the present invention is applicable for resolving various problems of a conventional fire-blocking door lock structure by simplifying the door lock structure, modularizing various component assemblies for easy assembly and manufacture, enabling a user to easily open the fire-blocking door with less applied force, and enabling the modulized components to be easily maintained such that the lifetime of the components can be prolonged; thus, the invention improves the efficacy and convenience of using a fire-blocking door.

It is of course to be understood that the embodiments described herein are merely illustrative of the principles of the invention and that a wide variety of equivalent modifications thereto may be effected by persons skilled in the art without departing from the spirit and scope of the invention as set forth in the following claims, such as changing the shapes of the upper and the lower supports, or the spring position on the draft bar, etc.

What is claimed is:

1. A fire-blocking door lock structure, comprising:

a bolt member connected with one end of an actuation mechanism inside the door lock structure, the bolt member comprising a pivot joint member, an operating piece penetrating the pivot joint member, a retaining piece disposed between the pivot joint member and the operating piece, and a driving piece pivotally connected with the pivot joint member and sleeved by a spring for generating a force in several phases; and two latch members connected with the other end, relatively away from the bolt member, of the actuation mechanism by two pull rods respectively, and symmetrically positioned on both sides of the actuation mechanism inside the door lock structure, the latch members each comprising:

a latching frame;

a latching support movably installed in the latching frame;

a latching body rotatably installed in the latching support and pivotally connected to the latching frame;

a stop piece movably installed in the latching frame and the latching support, for placing the latching body in an extension position where at least one part of the latching body extends out of the latching support, wherein when the stop piece is moved by a force, it allows the latching body to sit in a retraction position where the latching body retracts inside the latching support; and a driving piece having one end pivotally connected to the stop piece and the other end connected to the pull rods, for receiving a force from the pull rods to move the stop piece and drive the latching body to move between the extension position and the retraction position so as to lock and unlock the door lock structure.

2. The fire-blocking door lock structure of claim 1, wherein the pivot joint member comprises a first pivot joint and a second pivot joint rotatably and pivotally connected with the driving piece of the bolt member, the operating piece is coaxial with the pivot joint member and engaged between the first pivot joint and the second pivot joint, and the retaining piece is used for axially supporting axial extension of the operating piece and the first pivot joint.

3. The fire-blocking door lock structure of claim 1, wherein the operating piece is a latch.

4. The fire-blocking door lock structure of claim 1, wherein the first pivot joint is pivoted on a draft bar to be shifted between a first position of the draft bar where the draft bar is engaged with the operating piece and opens the operating piece, and a second position of the draft bar where the draft bar is disengaged from the operating piece and fails to open the operating piece; and the second pivot joint biases the first pivot joint at the first position or the second position by means of the spring on the driving piece of the bolt member.

5. The fire-blocking door lock structure of claim 1, wherein the latching frame accommodates the latching support, the latching body, the stop piece, and the driving piece of the latch member.

6. The fire-blocking door lock structure of claim 1, wherein the latching frame and the latching support are formed with guide slots respectively corresponding to each other.

7. The fire-blocking door lock structure of claim 1, wherein the latching support accommodates the latching body, the stop piece, and the driving piece of the latch member.

8. The fire-blocking door lock structure of claim 1, wherein the latching body and the latching frame are penetrated by a first shaft for being jointly actuated.

9. The fire-blocking door lock structure of claim 1, wherein the latching body is moved to the retraction position inside the latching support to unlock the door lock structure.

10. The fire-blocking door lock structure of claim 1, wherein the latching body is moved to the extension position where the at least one part of the latching body extends out of the latching support outside the latching support by the stop piece for to lock the door lock structure.

11. The fire-blocking door lock structure of claim 1, wherein the latching body is formed with a stop portion.

12. The fire-blocking door lock structure of claim 11, wherein the stop portion is positioned corresponding to the stop piece.

13. The fire-blocking door lock structure of claim 12, wherein the stop piece is in contact with the stop portion for keeping the latching body at the extension position.

14. The fire-blocking door lock structure of claim 1, wherein the latching frame, the latching support, the stop piece, the stop piece, and one end, which is connected to the stop piece, of the driving piece of the latch member are penetrated by a second shaft for being jointly actuated.

15. The fire-blocking door lock structure of claim 1, wherein the latching support, the driving piece of the latch member, and one end of the corresponding pull rod are penetrated by a third shaft for being jointly actuated.

16. The fire-blocking door lock structure of claim 15, wherein the third shaft further penetrates a connecting unit of the pull rod, to allow the latching support, the driving piece of the latch member and the pull rod to be jointly actuated, such that the latch member are simultaneously actuated by the pull rod that is driven by a force from movement of the actuation mechanism inside the door lock structure, so as to move the latching body to the retraction position inside the latching support for unlocking the door lock structure, and wherein when the force is released, the latching body is moved to the extension position to lock the door lock structure.

17. The fire-blocking door lock structure of claim 1, wherein the stop piece is formed with a positioning portion.

18. The fire-blocking door lock structure of claim 17, wherein the positioning portion of the stop piece and the driving piece of the latch member are coupled by a first spring member formed in-between.

19. The fire-blocking door lock structure of claim 1, wherein the driving piece of the latch member and the latching frame are coupled by a second spring member in-between for generating an elastic force.

* * * * *